US009256205B2

(12) United States Patent
Jamin et al.

(10) Patent No.: US 9,256,205 B2
(45) Date of Patent: Feb. 9, 2016

(54) OSCILLATING WEIGHT FOR AUTOMATIC WATCH

(75) Inventors: Mathieu Jamin, Champigny sur Marne (FR); Mathieu Ferrand, Orchamps-Velles (FR); Etienne Lebreton, Renens (CH)

(73) Assignee: CHRISTIAN DIOR COUTURE SA, Paris (FR)

( * ) Notice: Subject to any disclaimer, the term of this patent is extended or adjusted under 35 U.S.C. 154(b) by 542 days.

(21) Appl. No.: 13/345,250

(22) Filed: Jan. 6, 2012

(65) Prior Publication Data

US 2012/0243387 A1 Sep. 27, 2012

(30) Foreign Application Priority Data

Mar. 23, 2011 (CH) ..... 0522/11

(51) Int. Cl.
*G04B 5/16* (2006.01)

(52) U.S. Cl.
CPC ..... *G04B 5/16* (2013.01)

(58) Field of Classification Search
CPC ..... G04B 5/16; G04B 5/165
USPC ..... 368/148, 152, 206–208
See application file for complete search history.

(56) References Cited

U.S. PATENT DOCUMENTS

| | | | | | |
|---|---|---|---|---|---|
| 4,910,720 | A * | 3/1990 | Ray et al. | ..... | 368/148 |
| 6,354,731 | B1 * | 3/2002 | Halter | ..... | 368/148 |
| D481,323 | S * | 10/2003 | Filiberti | ..... | D10/128 |
| D481,324 | S * | 10/2003 | Filiberti | ..... | D10/128 |
| D481,644 | S * | 11/2003 | Filiberti | ..... | D10/128 |
| D630,960 | S * | 1/2011 | Vogeli | ..... | D10/128 |
| 2006/0050617 | A1 * | 3/2006 | Papi | ..... | 368/203 |
| 2010/0054089 | A1 * | 3/2010 | Maier et al. | ..... | 368/169 |
| 2010/0278018 | A1 * | 11/2010 | Jouvenot | ..... | 368/208 |

FOREIGN PATENT DOCUMENTS

| | | |
|---|---|---|
| CH | 695 394 A5 | 4/2006 |
| EP | 2 230 570 A2 | 9/2010 |

OTHER PUBLICATIONS

Google Translation of CH695394, retrieved from the internet Apr. 21, 2014.*
International Type Search Report issued in Swiss Application No. CH 5222011 (with trans)., dated Dec. 19, 2011.

* cited by examiner

*Primary Examiner* — Vit W Miska
(74) *Attorney, Agent, or Firm* — Oliff PLC

(57) ABSTRACT

Oscillating weight for automatic watch movement, having a massive peripheral ring in the shape of an arc of circle, a connecting element connecting the peripheral ring to the weight's pivoting center, wherein the connecting element is set with a plurality of stones.

23 Claims, 3 Drawing Sheets

OSCILLATING WEIGHT FOR AUTOMATIC WATCH

The present application claims priority from Swiss patent application CH522/11, filed on Mar. 23, 2011, the content of which being hereby incorporated by reference.

TECHNICAL FIELD OF THE INVENTION

The present invention relates to oscillating weights for automatic watches.

STATE OF THE PRIOR ART

Oscillating weights for automatic watches are well known and widespread. An oscillating weight typically enables the winding-up function of a movement to be performed thanks to the weight's oscillations generated by the movements of the watch wearer. The weight is mounted in pivoting fashion, for example by means of a bearing, and with a reverser ensuring that the weight's alternating movement is transformed into a unidirectional rotating movement. The reduction geartrains of the winding mechanism ensure the connection between the different elements. Driving the winding mechanism in rotation makes it possible to wind up the barrel spring.

In classical fashion, the oscillating weight of a watch is placed at the bottom of the case and is thus not visible to the watch wearer. It therefore does not contribute to enriching the aesthetic aspect or the design of the watch.

EP334088 describes a watch provided with an oscillating weight positioned in front of the dial. The oscillating weight however lacks visual or decorative elements.

Document CH700711 describes an oscillating weight comprising highly hollowed-out arms of composite material. This type of arm does not allow aesthetic or decorative elements to be machined in a reliable and durable manner.

EP1445668 also describes an oscillating weight having very hollowed-out arms and allowing the mass center to be displaced to adapt it to the wearer's level of activity. This type of arm also does not allow aesthetic or decorative elements to be machined in a reliable and durable manner.

Oscillating weights provided with diamonds mounted on the peripheral ring are also known. This type of configuration strongly restricts the zones likely to bear diamonds, thus reducing their visibility accordingly. The designers also have no possibilities for creating original visual arrangements other than in the shape of an arc of circle along the ring.

The invention provides technical means to overcome these different disadvantages.

DESCRIPTION OF THE INVENTION

A first object of the invention consists in providing an oscillating weight for automatic watches adapted in order to be visible by the watch bearer.

Another object of the invention consists in providing an oscillating weight that allows the other elements of the movement to be at least partly visible.

Another object of the invention consists in providing an oscillating weight that enables the thickness of the watch to be reduced.

Another object of the invention consists in providing an oscillating weight for automatic watches having remarkable aesthetic qualities, without however compromising on basic functions such as ensuring that the watch can be wound up.

Another object of the invention consists in providing an oscillating weight for automatic watches having remarkable aesthetic qualities, without however affecting the characteristics of resistance performance and mechanical endurance.

Another object of the invention consists in providing an automatic watch provided with an oscillating weight visible to the wearer and having remarkable aesthetic qualities, without compromising on the watch's mechanical qualities.

For this purpose, the invention provides an oscillating weight for automatic watch movement having a massive peripheral part, such as a ring in the shape of an arc of circle, a connecting element extending from the peripheral ring toward the weight's pivoting center, wherein the connecting element is set with a plurality of stones and wherein the connecting element allows the dial and/or the hands or other elements to be seen through it.

In this context, the term "stone" designates any natural stone, such as a diamond, or synthetic stone. Ruby, emerald, sapphire, quartz or cut ceramics are non-limiting examples of stones in the context of this invention. A stone in this context can thus be of precious or semi-precious kind.

This architecture showcases the aesthetic aspect. The fact that the stones are both visible and moving contributes to captivating the wearer's attention thanks to the creation of novel visual effects. Furthermore, a considerable part of the weight is concentrated on the peripheral ring, which makes it particularly delicate to integrate machined elements on the arms whilst retaining mechanical properties that enable considerable torques to be transmitted between the periphery and the center through a stone chain such as diamonds. According to the invention, this aspect is particularly well-served thanks to the fact that in an advantageous embodiment, the connecting element is formed by a chain of stones set in a metallic support base. The metallic support base allows the weight's mechanical integrity, and in particular its rigidity and endurance, to be ensured.

Advantageously, the connecting element makes it possible to see through as it is provided with arms between which there are openings allowing the elements behind and/or in front of the oscillating weight to be at least partly seen.

The connecting element can connect the peripheral part to the pivoting point at the center of the watch. The connecting element can extend from the peripheral part toward the center of the watch but without exactly reaching this center. The connecting element can connect the peripheral part to a ring around the center of the watch.

Advantageously, at least one of the stones is a diamond. Other types of stones and/or of decorative elements can also be used. The fact that the oscillating weight is mobile makes it possible to superbly showcase the diamonds that captivate the eyes of the wearer. The latter will then be reminded more often to perform motions likely to wind up the movement.

Also advantageously, the weight is adapted to be positioned in front of the dial of the watch that it is intended to wind up. This position enables the wearer to best enjoy the aesthetic qualities of the oscillating weight whilst enjoying a visual means to remember the necessity of performing at the appropriate time the motions required to wind up the watch movement.

In another embodiment, the weight can also be behind the dial, for example on a pivoting watch or on a skeleton movement that would leave the weight visible. A glass or crystal could be provided on the bottom of the watch in order to enable the user to see the weight.

In another embodiment, the plurality of stones is set above the connecting element and it is visible from the watch glass. In another embodiment, this plurality of stones is set under the connecting element and it is visible from the bottom of the watch if this bottom is provided with a glass or in the case of a skeleton watch. In another embodiment, this plurality of stones is set simultaneously above and below the connecting element.

According to another embodiment, the metallic support base comprises a plurality of arms connecting the bearing to the peripheral ring. In one embodiment, the arms are in the shape of an arc of circle and work together.

According to another embodiment, the oscillating weight includes a bearing, centered on the pivoting axis, and the metallic support base extends roughly around the weight's bearing and a plurality of stones are placed so as to surround at least partially the bearing.

In another embodiment, at least some of the stones are placed in a manner roughly adjacent to the peripheral ring.

The invention also provides an automatic watch comprising a movement and an oscillating weight as mentioned here above, arranged to perform the winding up of the movement. The oscillating weight is arranged so as to be visible by the watch wearer and it is connected to the barrel by a set of gearings working on the one hand with the weight, at its pivoting axis, and on the other hand with the barrel, so as to wind the latter's spring.

Advantageously, the weight is positioned in front of the watch dial.

The connecting gearings between the weight and the barrel are preferably placed on a plate that can be adapted to a preexisting automatic watch movement. These connecting gearings are advantageously placed roughly at the center of the movement.

DESCRIPTION OF THE FIGURES

All details of embodiments are given in the following description, completed by FIGS. 1 to 3, given only by way of non-limiting examples and wherein.

DETAILED DESCRIPTION OF THE INVENTION

Figure 1A:
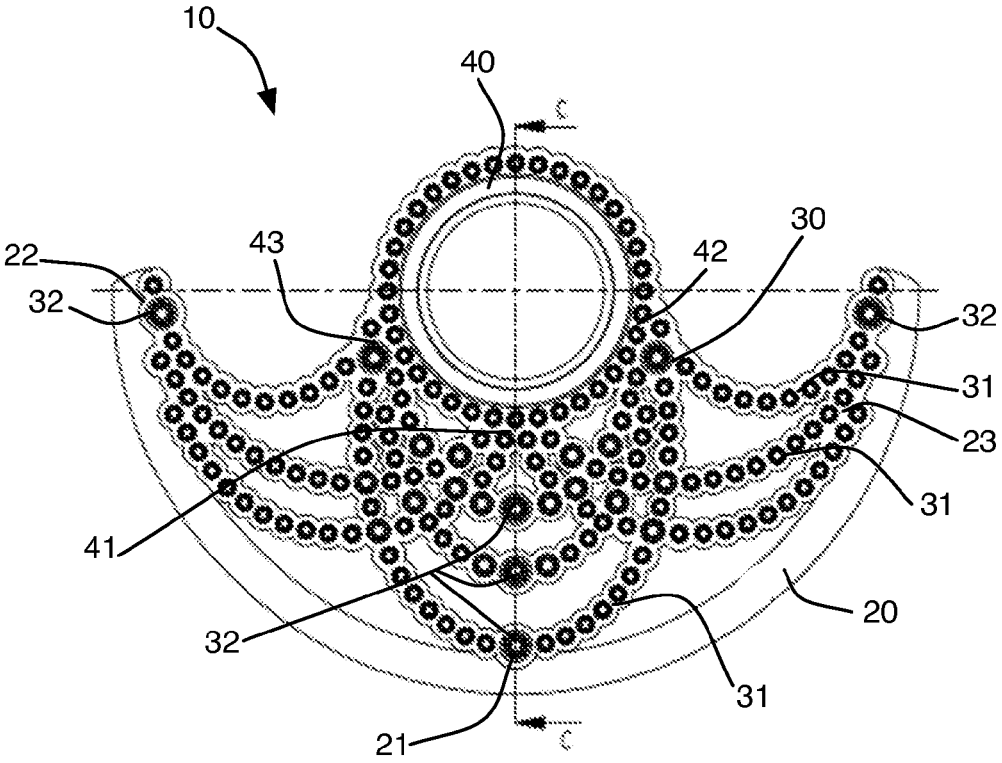
FIG. 1A is a top view of a first embodiment of an oscillating weight according to the invention.

FIG. 1A illustrates a first embodiment of the oscillating weight 10 according to the invention. A peripheral semi-ring 20 is connected through a connecting element 30 to a bearing element 40, provided with a pivoting axis P-P visible in FIG. 1B. A considerable part of the mass of the whole assembly is concentrated on the peripheral ring 20, so that the center of gravity of the oscillating weight 10 is as far removed as possible from the pivoting axis P-P. To achieve these characteristics, as well as to ensure its durability whilst presenting an agreeable aspect, the peripheral ring can be made of metal alloy such as inox steel, gold or platinum. The bearing 40, in addition to delimiting the pivoting axis P-P, enables the oscillating weight 10 to be connected in pivoting fashion to a movement of an automatic watch.

The connecting element 30 comprises a plurality of arms 31, each connecting a given point of the periphery of the bearing 40 to a given point of the peripheral ring 20. It is thus possible to achieve multipoint connections. In the example of FIG. 1A, three points or zones 41, 42 and 43 of the bearing's lower periphery each serve to fasten a plurality of arms 31 oriented towards the peripheral ring 20. For example, on one side of the oscillating weight, an arm 31 extends between the point 43 of the bearing's periphery and the point or zone 22 of the peripheral ring. Another arm 31 extends between the point 43 and the point 21 of the peripheral ring. From the point 41 of the bearing's periphery, four arms 31 radiate towards the peripheral ring, i.e. two on each side. Similar arrangements are provided on each side of the oscillating weight in symmetrical fashion. Some arms 31 cross each other before reaching the contact points of the peripheral ring or of the bearing's periphery. Finally, in this embodiment, some arms starting at the bearing's periphery do not extend up to the peripheral ring. The crossing zones between the arms can serve as location for one or several stones. This also applies to the connecting points or zones between the arms and the peripheral ring or the bearing's periphery. The multiple arms 31 with their intercrossing zones form an appreciably rigid and durable unit, capable of resisting to the dynamic constraints linked to the pivoting movement of the oscillating weight. The symmetrical arrangement makes it possible to obtain a good balancing.

The connecting element 30 is constituted of a metallic support base 33 on which a plurality of stones 32 are set. As illustrated in FIG. 1A, at least some of the stones 32 are diamonds.

Figure 1B:
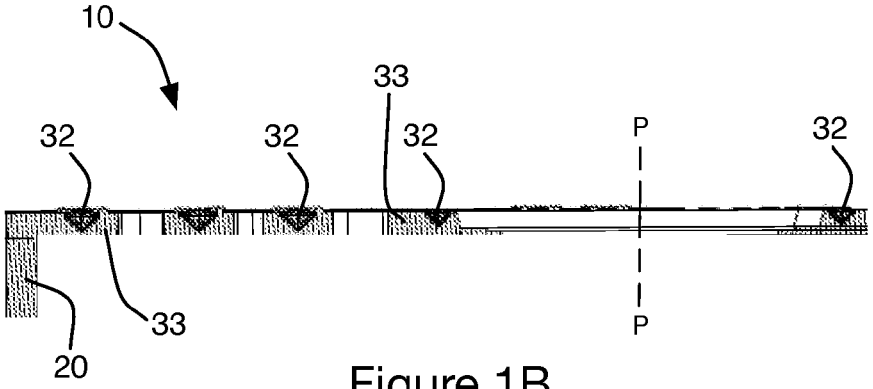
FIG. 1B is a cross-section view, along the arrow C-C, of the oscillating weight shown in FIG. 1A.

As can be seen in FIG. 1B, the stones 32 are set in the metallic support base 33 from the visible side of the oscillating weight, thus contributing to embellishing its appearance. The setting is such that the stones are more or less completely inserted into the metallic support base 33, forming a roughly uniform visible surface. Such integration makes it possible to ensure that the stones are fastened in reliable and durable manner in the support.

Figure 2A:
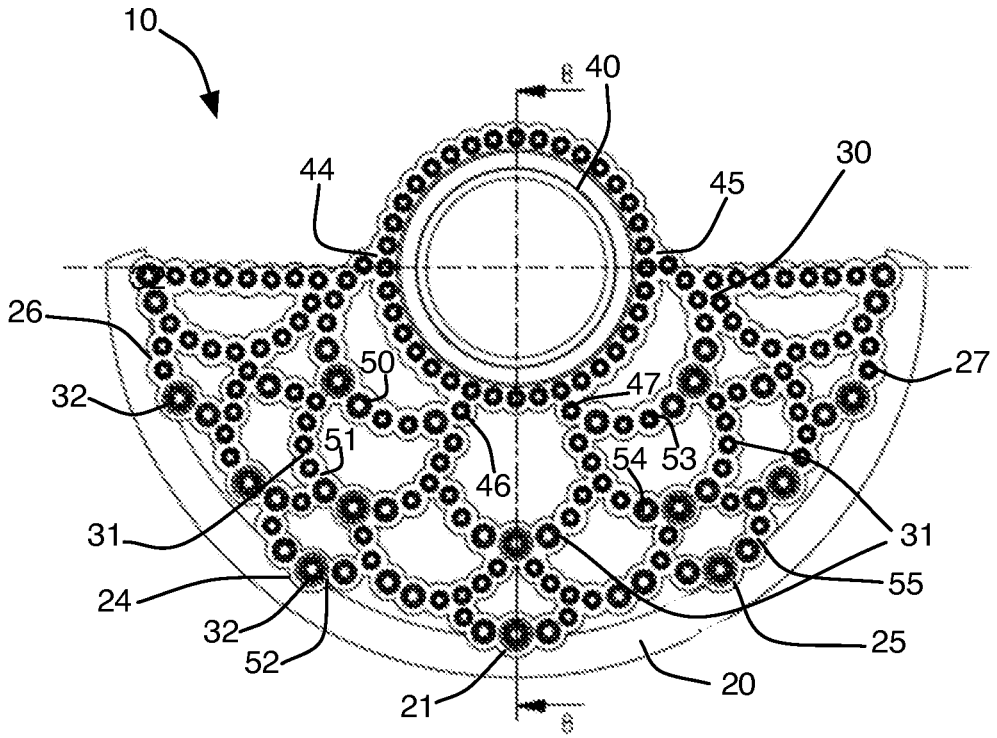
FIG. 2A is a top view of a second embodiment of an oscillating weight according to the invention.
Figure 2B:
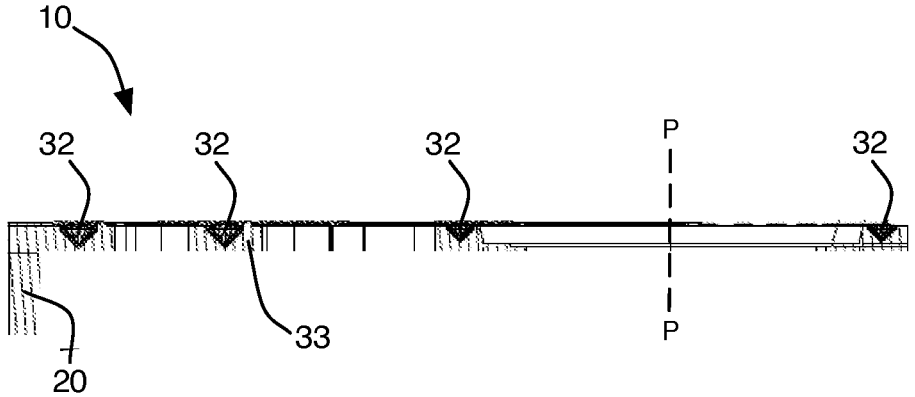
FIG. 2B is a cross-section view, along the arrow B-B, of the oscillating weight shown in FIG. 2A.

FIGS. 2A and 2B show another embodiment of an oscillating weight 10 according to the invention. In this example, the arms 31 are arranged so as to form arcs of circle working with one another. On each side of the oscillating weight, two anchor points 44, 46 and 45, 47 are provided in the lower quadrant of each side of the bearing. These points serve to anchor a plurality of arms 31 provided to ensure that the peripheral ring 20 is held. In addition to the median point 21, two other anchor points or zones 24, 26, 25, 27 are provided on each side of the peripheral ring. In this embodiment, the arms 31 extend radially towards the peripheral ring 20 by forming successive arcs of circle, such as for example the arcs 50, 51 and 52 of a first side and 53, 54 and 55 of the other side. Other arcs of circle are thus formed on each side of the oscillating weight. Such an arrangement, with a large number of arms and crossings between the arms, makes it possible to ensure the rigidity of the whole. The symmetric arrangement makes it possible to achieve a good balancing.

Figure 3A:
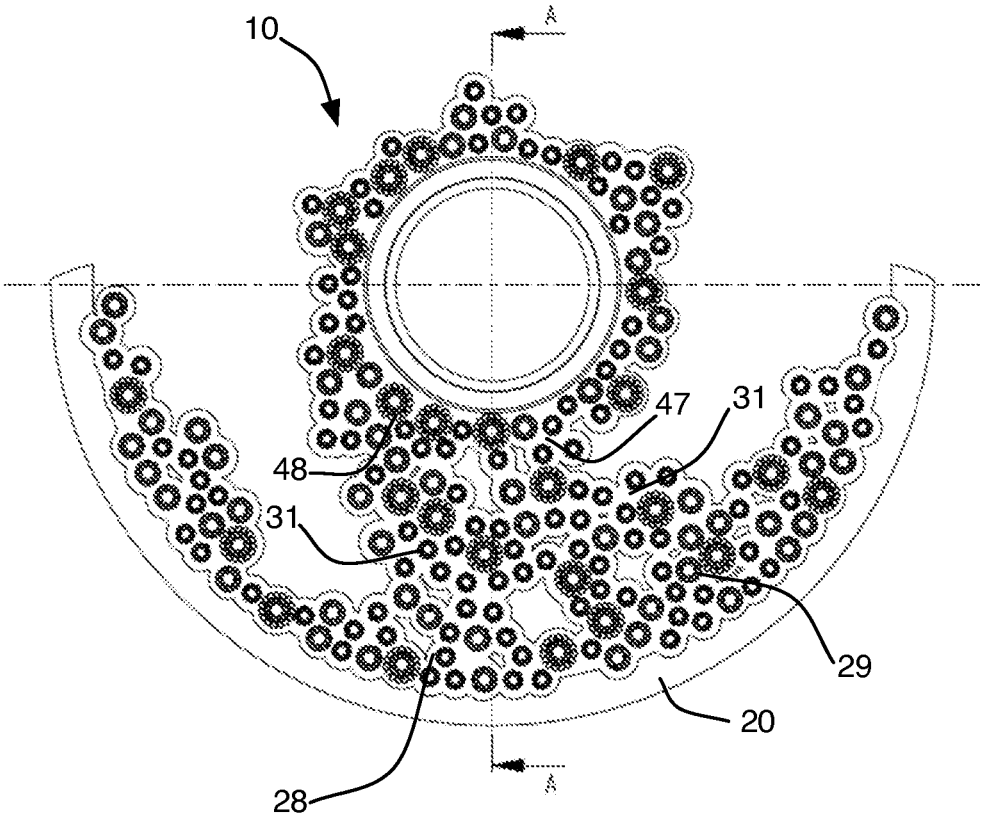
FIG. 3A is a top view of a third embodiment of an oscillating weight according to the invention.
Figure 3B:
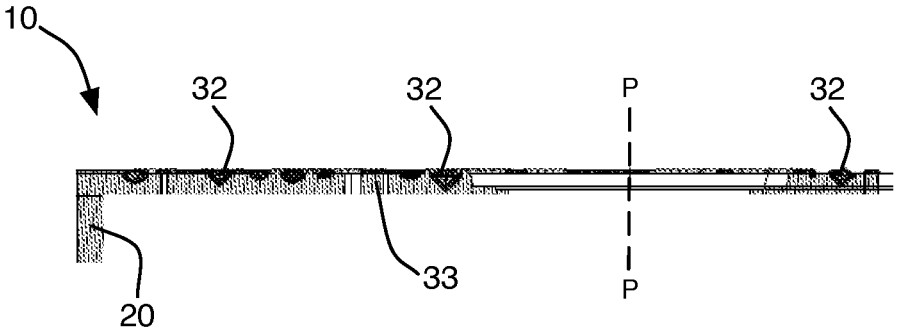
FIG. 3B is a cross-section view, along the arrow A-A, of the oscillating weight shown in FIG. 3A.

FIGS. 3A and 3B illustrate another embodiment of an oscillating weight according to the invention. In this example, two arms 31 having irregular and non-symmetrical shapes are placed on each side of the symmetry axis of the oscillating weight. One arm 31 extends between the points or zones 48 of the bearing's periphery and the point or zone 28 of the peripheral ring. Another arm extends between the point or zone 47 of the bearing's periphery and the point or zone 29 of the peripheral ring. In this embodiment, the arms are less numerous than in the preceding examples but are considerably larger, thus contributing towards sufficient rigidity to achieve a stable and accurate operation during a very high number of cycles.

In this embodiment, the metallic support base 33 comprises ramifications along the peripheral ring 20 for stones to be inserted along the latter, in the radially interior zone. A same type of ramification of the metallic support base 33 along the periphery of the bearing 40 allows stones to be inserted along the latter in the radially exterior zone of the bearing. The distribution of the stones in such a non-symmetrical arrangement is preferably provided to ensure a good balancing between the two sides of the oscillating weight. This balancing can be based on the respective positioning and masses of the different stones provided on the oscillating mass.

Multiple variant embodiments can be executed without falling outside the scope of the invention, by simply varying the number of arms, their shape, the number and/or positions of the anchor points or zones, etc.

In a preferred embodiment, the connecting element is constrained by being as thin as possible in order to prevent the watch from being too thick. According to this embodiment, the visual impact of the metallic parts seen from the front is lightened and the thickness of the connecting element is limited as much as possible. However, this element must be sufficiently robust. In a variant embodiment, the total thickness of the connecting element is equal to or very slightly greater than the thickness of the stones. The stone itself has constrained proportions that satisfy a maximum of brilliancy. The diameter of the stones is maximized whilst the thickness of the connecting element is limited. The holes or voids situated in the connecting element can thus be either nearly traversing (as illustrated in FIG. 1A) or be truly traversing.

The oscillating mass according to the invention is intended for integration in an automatic watch for winding up the movement. Such a watch classically comprises an energy accumulator, often a barrel, provided to work with the oscillating weight, in order to fulfill this function. Thus, the oscillating weight makes it possible to supply energy to the accumulator by winding up the latter's spring. The energy accumulator serves to power a time base of the movement, itself driving the gearing.

In an advantageous variant embodiment, the oscillating weight 20 is integrated to an existing watch movement. To this effect, an adaptation plate is placed on the basic mechanical movement of the watch. This plate serves to accommodate gearings adapted to ensure the connection between the oscillating weight and the barrel.

The invention claimed is:

1. Oscillating weight for automatic watch movement, having:

a massive peripheral ring in the shape of an arc of circle;

a connecting element, extending from the peripheral ring toward the weight's pivoting center; and a bearing centered on the pivoting axis, the connecting element being set with a plurality of stones, the connecting element having openings defined therein, the connecting element connecting the peripheral ring to a ring around the weight's pivoting center, the connecting element comprising a chain of the stones set in a metallic support base, and the metallic support base including a plurality of arms comprising the chain of the stones, the arms connecting the bearing to the peripheral ring, at least some of the plurality of arms being arranged to cross each other so that each arm of said at least some of said plurality of arms crosses at least two different arms while extending from the peripheral ring toward the pivoting center.

2. Oscillating weight according to claim 1, wherein at least one of the stones is a diamond.

3. Oscillating weight according to claim 1, adapted to be positioned in front of the dial of the watch that it is intended to wind up.

4. Oscillating weight according to claim 1, wherein the metallic support base extends roughly around the bearing and a plurality of stones are placed so as to surround at least partially the bearing.

5. Oscillating weight according to claim 1, wherein the arms are in the shape of an arc of circle and work together.

6. Oscillating weight according to claim 1, wherein the metallic support base has an asymmetric shape.

7. Oscillating weight according to claim 3, wherein at least part of the stones are placed in a manner roughly adjacent to the ring.

8. An oscillating weight according to claim 1, wherein said plurality of arms which are arranged to cross each other comprises at least two arms which cross at at least one point along their lengths, said point being remote from end extremities of the arms.

9. An oscillating weight according to claim 1, wherein at least some of the arms have a series of undulations along the lengths of said arms.

10. An oscillating weight according to claim 9, wherein the undulations are located along the sides of said arms.

11. An oscillating weight according to claim 9, wherein the curvature of each of the series of undulations is such that a distance between an outer surface of a stone closest to an undulation and an outer surface of the undulation is substantially constant over an entirety of the undulation.

12. An oscillating weight according to claim 1, wherein some of the plurality of arms are arranged to cross each other at a plurality of crossing points, the arrangement of said crossing points and of said arms being symmetrical with regard to an axis passing from the pivoting center.

13. An oscillating weight according to claim 1, wherein the bearing comprises at least a first bearing anchor zone and a second bearing anchor zone distinct from the first bearing anchor zone, the massive peripheral ring comprises a first ring anchor zone and a second ring anchor zone distinct from the first ring anchor zone, and the plurality of arms comprises a first arm extending from the first bearing anchor zone to the first ring anchor zone, a second arm extending from the first bearing anchor zone to the second ring anchor zone, a third arm extending from the second bearing anchor zone to the first ring anchor zone, and a fourth arm extending from the second bearing anchor zone to the second ring anchor zone.

14. Automatic watch comprising a dial;

a movement; and an oscillating weight positioned in front of said dial and arranged to ensure the winding up of the movement, said oscillating weight comprising a massive peripheral part, a connecting element extending from the massive peripheral part toward the center of the watch, and a bearing centered on the pivoting axis, the connecting element being set with a plurality of stones, the connecting element having openings defined therein, the connecting element connecting the peripheral part to a ring around the weight's pivoting center, the connecting element comprising a chain of the stones set in a metallic support base, and the metallic support base including a plurality of arms comprising the chain of the stones, the arms connecting the bearing to the peripheral part, at least some of the plurality of arms being arranged to cross each other so that each arm of said at least some of said plurality of arms crosses at least two different arms while extending from the peripheral ring toward the pivoting center.

15. Automatic watch according to claim 14, said oscillating weight being connected to a barrel of said movement by a set of gearings working on the one hand with the weight, at its pivoting axis, and on the other hand with the barrel, so as to wind the latter's spring.

16. Automatic watch according to claim 15, wherein connecting gearings between the weight and the barrel are placed roughly at the center of the movement.

17. Automatic watch according to claim 14, wherein connecting gearings between the oscillating weight and the barrel are placed on a plate above an automatic watch movement.

18. An automatic watch according to claim 14, wherein said plurality of arms which are arranged to cross each other comprises at least two arms which cross at at least one point along their lengths, said point being remote from end extremities of the arms.

19. An automatic watch according to claim 14, wherein at least some of the arms have a series of undulations along the lengths of said arms.

20. An automatic watch according to claim 19, wherein the undulations are located along the sides of said arms.

21. An automatic watch according to claim 19, wherein the curvature of each of the series of undulations is such that a distance between an outer surface of a stone closest to an undulation and an outer surface of the undulation is substantially constant over an entirety of the undulation.

22. An automatic watch according to claim 14, wherein some of the plurality of arms are arranged to cross each other at a plurality of crossing points, the arrangement of said crossing points and of said arms being symmetrical with regard to an axis passing from the pivoting center.

23. An automatic watch according to claim 14, wherein the bearing comprises at least a first bearing anchor zone and a second bearing anchor zone distinct from the first bearing anchor zone, the massive peripheral ring comprises a first ring anchor zone and a second ring anchor zone distinct from the first ring anchor zone, and the plurality of arms comprises a first arm extending from the first bearing anchor zone to the first ring anchor zone, a second arm extending from the first bearing anchor zone to the second ring anchor zone, a third arm extending from the second bearing anchor zone to the first ring anchor zone, and a fourth arm extending from the second bearing anchor zone to the second ring anchor zone.

* * * * *